US009327956B2

(12) United States Patent
Forte

(10) Patent No.: US 9,327,956 B2
(45) Date of Patent: May 3, 2016

(54) WATER DISPENSER WITH BAG IN A BOX UNIT

(71) Applicant: NEVIOT NATURE GALILEE LTD, Lod (IL)

(72) Inventor: Yehuda Forte, Yavne (IL)

(73) Assignee: NEVIOT NATURE GALILEE LTD, Lod (IL)

( * ) Notice: Subject to any disclaimer, the term of this patent is extended or adjusted under 35 U.S.C. 154(b) by 87 days.

(21) Appl. No.: 13/956,401

(22) Filed: Aug. 1, 2013

(65) Prior Publication Data

US 2014/0263449 A1 Sep. 18, 2014

(30) Foreign Application Priority Data

Mar. 18, 2013 (IL) ..... 225324

(51) Int. Cl.
*B67D 1/00* (2006.01)
*B67D 1/06* (2006.01)
(Continued)

(52) U.S. Cl.
CPC ..... *B67D 1/0004* (2013.01); *B67D 1/001* (2013.01); *B67D 1/0005* (2013.01); *B67D 1/0007* (2013.01); *B67D 1/0012* (2013.01); *B67D 1/06* (2013.01); *B67D 1/0857* (2013.01); *B67D 1/0888* (2013.01); *B67D 1/0895* (2013.01); *B67D 1/1231* (2013.01); *B67D 3/0009* (2013.01); *B67D 3/0022* (2013.01); *B67D 3/0029* (2013.01); *B67D 3/0038* (2013.01); *B67D 3/0041* (2013.01); *B67D 3/0083* (2013.01); *B67D 3/0016* (2013.01); *B67D 2001/0827* (2013.01); *B67D 2210/00031* (2013.01)

(58) Field of Classification Search
CPC .. B67D 1/0005; B67D 1/0004; B67D 1/0007; B67D 1/001; B67D 1/0012; B67D 1/06; B67D 1/0857; B67D 1/0888; B67D 1/1231; B67D 1/0895; B67D 3/0009; B67D 3/0022; B67D 3/0029; B67D 3/0038; B67D 3/0041; B67D 3/0083; B67D 3/0016; B67D 2210/00031; B67D 2001/0827
USPC ..... 222/105, 146.1–146.2, 146.6
See application file for complete search history.

(56) References Cited

U.S. PATENT DOCUMENTS 3,688,950 A 9/1972 Parish
4,341,328 A 7/1982 Redick, Jr.
(Continued)

FOREIGN PATENT DOCUMENTS

EP 1584602 10/2005
WO 2008-099796 8/2008
(Continued)

*Primary Examiner* — Frederick C Nicolas
(74) *Attorney, Agent, or Firm* — Soroker-Agmon

(57) ABSTRACT

The subject matter discloses an apparatus, which includes a housing; a mineral water container positioned within the housing and formed as a bag and box package unit; a chilled water faucet and a hot water faucet configured to dispense chilled mineral water and hot mineral water from the apparatus. In some cases, the apparatus further includes a cold water tank for receiving water at room temperature from the mineral water container and supply cold water to the cold water faucet and a hot water tank for receiving water at room temperature from the mineral water container and supply hot water to the hot water faucet. The apparatus may include a pump for pumping water from the mineral water container to the cold water tank and the hot water tank.

14 Claims, 10 Drawing Sheets

(51) Int. Cl.

| | |
|---|---|
| ***B67D 1/08*** | (2006.01) |
| ***B67D 1/12*** | (2006.01) |
| *B67D 3/00* | (2006.01) |

(56) References Cited

U.S. PATENT DOCUMENTS

| | | | | |
|---|---|---|---|---|
| 4,881,380 | A | 11/1989 | Mrugala | |
| 4,958,747 | A | 9/1990 | Sheets | |
| 5,042,689 | A * | 8/1991 | Mrugala et al. | 222/66 |
| 5,361,942 | A | 11/1994 | Salkeld et al. | |
| 5,573,142 | A | 11/1996 | Morellato et al. | |
| 6,143,258 | A | 11/2000 | Tamura et al. | |
| 6,207,046 | B1 | 3/2001 | Yamashita et al. | |
| 6,453,955 | B1 | 9/2002 | Lee | |
| 6,793,099 | B1 | 9/2004 | Sleiman | |
| 6,871,675 | B1 | 3/2005 | Marszalec | |
| 6,926,170 | B2 | 8/2005 | Groesbeck | |
| 7,268,698 | B2 | 9/2007 | Hart et al. | |
| 7,975,879 | B2 | 7/2011 | Groesbeck | |
| 7,980,422 | B2 | 7/2011 | Lassota | |
| 8,196,777 | B2 | 6/2012 | Nakano | |
| 2008/0142548 | A1 | 6/2008 | Moen et al. | |
| 2008/0277417 | A1 * | 11/2008 | Groesbeck | 222/105 |
| 2009/0283542 | A1 * | 11/2009 | Cruysberghs | 222/129 |
| 2010/0116847 | A1 | 5/2010 | Foroughi et al. | |
| 2011/0017776 | A1 | 1/2011 | Metropulos et al. | |
| 2011/0045152 | A1 * | 2/2011 | Stutz et al. | 426/433 |
| 2011/0303693 | A1 * | 12/2011 | Culley et al. | 222/1 |
| 2012/0193375 | A1 | 8/2012 | Forte | |
| 2012/0248141 | A1 * | 10/2012 | Sano et al. | 222/52 |

FOREIGN PATENT DOCUMENTS

| | | |
|---|---|---|
| WO | 2012/117399 | 9/2012 |
| WO | 2013098817 | 7/2013 |

* cited by examiner

WATER DISPENSER WITH BAG IN A BOX UNIT

FIELD OF THE INVENTION

The subject matter relates generally to water dispensers, and more specifically to mineral water dispensers having water packaged in bags that package in a box.

BACKGROUND OF THE INVENTION

Water dispensers are used in both businesses and for residential use to provide available water to users. The demands to ensure safety of drinking water and to pursue the quality in natural character of drinking water have been increased according to the increase of users' interest with respect to drinking water.

Water dispensers may provide users with filtered water. Such filtered water is received at the water dispenser from a central water system and filtered via a filtering module within the water dispenser. Other water dispensers provide users with mineral water. Such mineral water is packaged in periodically replaced containers. The containers have an outlet connected to a faucet from which the water is dispensed.

In the residential market, water dispensers that carry water containers are likely to consume a significant volume, which is limited to the area of a standard kitchen. The water dispensers have a housing in which the water pipes, chilling unit and circuitry may be positioned. The mineral water containers are positioned on top of the housing, as they carry an amount of about 19 liters or 10/11 Liter and users find it cumbersome to insert a 19-liter or 10/11 Liter water container into the housing. Many residential consumers prefer having the water dispenser in the kitchen for convenience. Water dispensers having a water container externally to the housing of the water dispenser are likely to consume a larger space.

SUMMARY

It is an object of the subject matter to disclose an apparatus, comprising:

a housing; a mineral water container positioned within the housing and formed as a bag and box package unit; a chilled water faucet configured to dispense chilled mineral water; a hot water faucet configured to dispense hot mineral water; a first pipe connecting the mineral water bag to the chilled water faucet; a second pipe connecting the mineral water bag to the hot water faucet.

In some cases, the apparatus further comprises a cold water tank for receiving water at room temperature from the mineral water bag and supply cold water to the cold water faucet, wherein the cold water tank is connected to a cooling unit for cooling the water in the cold water tank.

In some cases, the cooling unit is positioned within the housing.

In some cases, the apparatus further comprises a pump for pumping water from the mineral water bag to the cold water tank. In some cases, the pump is activated when a predefined amount of water is supplied by the cold water faucet.

In some cases, the apparatus further comprises a hot water tank for receiving mineral water at room temperature from the mineral water bag and supply hot water to the hot water faucet, wherein the hot water tank is connected to a heating unit for heating the water in the hot water tank. In some cases, the pump is further configured for pumping water from the mineral water bag to the cold water tank. In some cases, the apparatus is further configured to dispense lukewarm water by dispensing water from the cold water tank and from the hot water tank to a lukewarm water faucet.

In some cases, the apparatus is adapted for residential users. In some cases, the apparatus enables replacement of the mineral water container on a kitchen worktop when the apparatus is positioned on a kitchen worktop.

In some cases, the apparatus further comprises a receiving unit, wherein the receiving unit comprises a plurality of icons displayed a display device of the apparatus, wherein each of said plurality of icons represents an amount of mineral water dispensed by the apparatus. In some exemplary embodiments of the subject matter, the receiving unit is a graphic user interface. In some cases, height of the water dispensing apparatus is lower than 60 centimeters.

In some cases, the apparatus further comprises a boiling unit for boiling water dispensed at the hot water faucet.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The disclosed subject matter provides for a compact water dispensing apparatus for residential use. The water dispensing apparatus comprises one or more chilled water container and one or more hot water container. The water containers may be formed as a bag in a box package unit. The bag in a box package unit comprises a rigid box having a bag filled with a liquid such as water. The bag in a box package unit may also be referred to as bag and box package unit. The water dispensing apparatus may also comprise a cooling unit for cooling the water in the chilled water container. The entire water dispensing apparatus is relatively small, about 45 centimeters high, while containing a total of about 7.25 L in the bag +1.8 L in the cold tank and 1.8 L in the cold tank, and the cooling and heating units.

Figure 1:
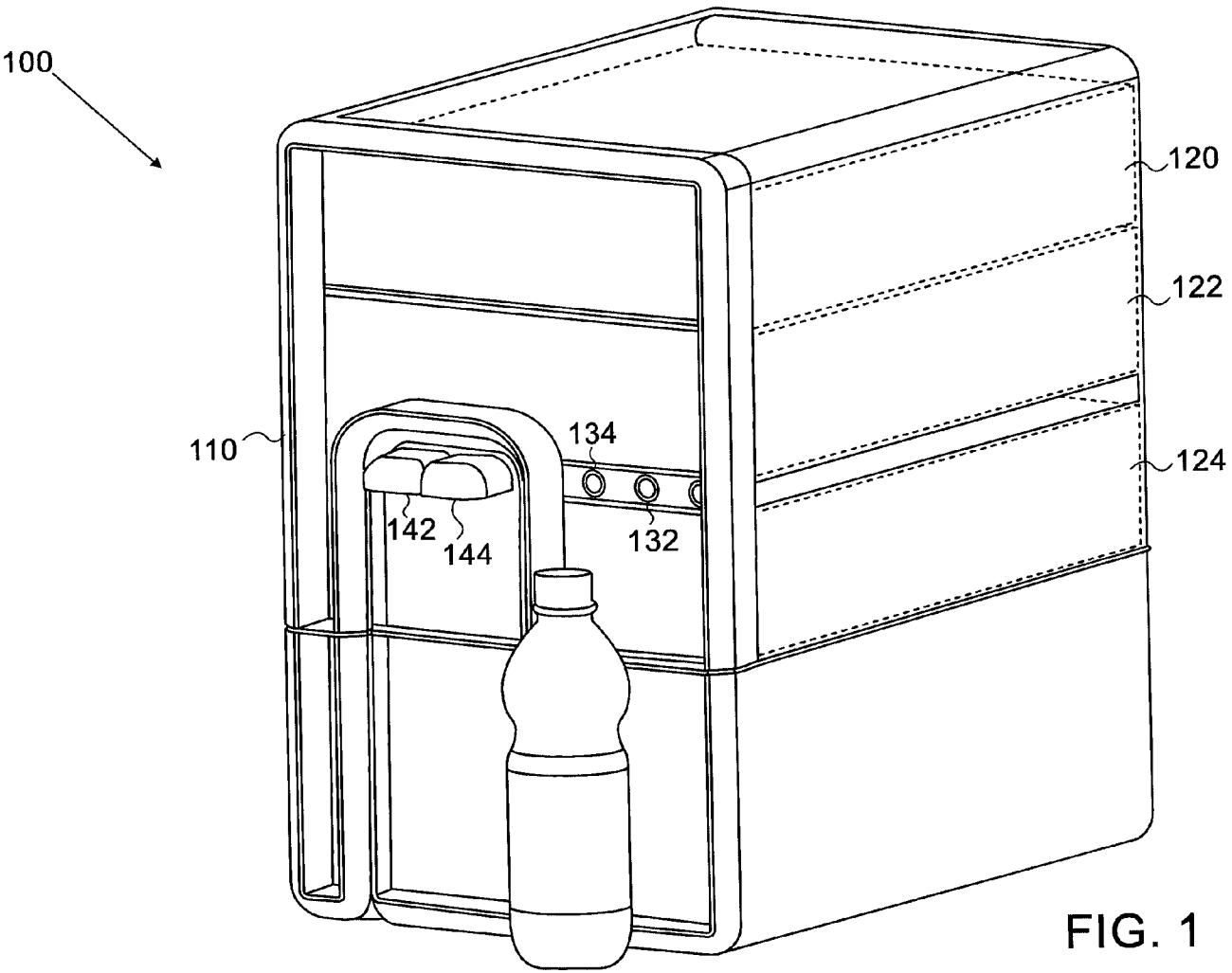
FIG. 1 shows a water dispensing apparatus, according to some exemplary embodiments of the subject matter.

FIG. 1 shows a water dispensing apparatus, according to some exemplary embodiments of the subject matter. The water dispensing apparatus 100 comprises a housing 110. The housing 110 may be of cubic-like shape, or a cuboid shape. The housing 110 may be made of plastic, metal, semi-rigid material or any other material desired by a person skilled in the art. The water dispensing apparatus 100 comprises a first chilled water container 120 positioned within the housing 110 and a second chilled water container 122 positioned within the housing 110. The water dispensing apparatus 100 also comprises a hot water tank 124 positioned within the housing 110. At least some water containers of the group consisting the first chilled water container 120, the second chilled water container 122 and the hot water container 124 may be formed as a bag in a box package unit. The volume of the water containers 120, 122, 124 may be in a range of 4-10 liters. In some exemplary cases, each of the water containers 120, 122, 124 contain 7 liters. The content of the water containers 120, 122, 124 is mineral water supplied by a mineral water provider.

The water dispensing apparatus 100 may also comprise a user interface enabling a user to control and operate the water dispensing apparatus 100. Such user interface may include a first button 132 and a second button 134. In some exemplary cases, the user of the water dispensing apparatus 100 uses the first button 132 for dispensing chilled water. Similarly, the user of the water dispensing apparatus 100 uses the second button 134 for dispensing hot water.

The water dispensing apparatus 100 may also comprise a dispensing section from which the water is dispensed to the user. The dispensing section comprises a first faucet 142 and a second faucet 144. The first faucet 142 is used for dispensing chilled water and the second faucet is used for dispensing hot water. The chilled water flows using gravitation from the first chilled water container 120 or the second chilled water container 122 to the first faucet 142 via a connecting pipe (not shown). There is no need for a pump when chilled water is dispensed to the user as water flow from the first chilled water container 120 or the second chilled water container 122 to the first faucet 142 using gravitation. In some exemplary cases, the bottom portions of both the first chilled water container 120 and the second chilled water container 122 are positioned higher than the first faucet 142.

The water inside the hot water container 124 is not heated. Water flow from the hot water container 124 to a heating zone comprising about a liter of water. In some exemplary cases, water is heated in the heating zone, not in the hot water container 124. When the user presses the second button 134, water are pumped from the heating zone to the second faucet 144 where the water is dispensed to the user.

Figure 2A:
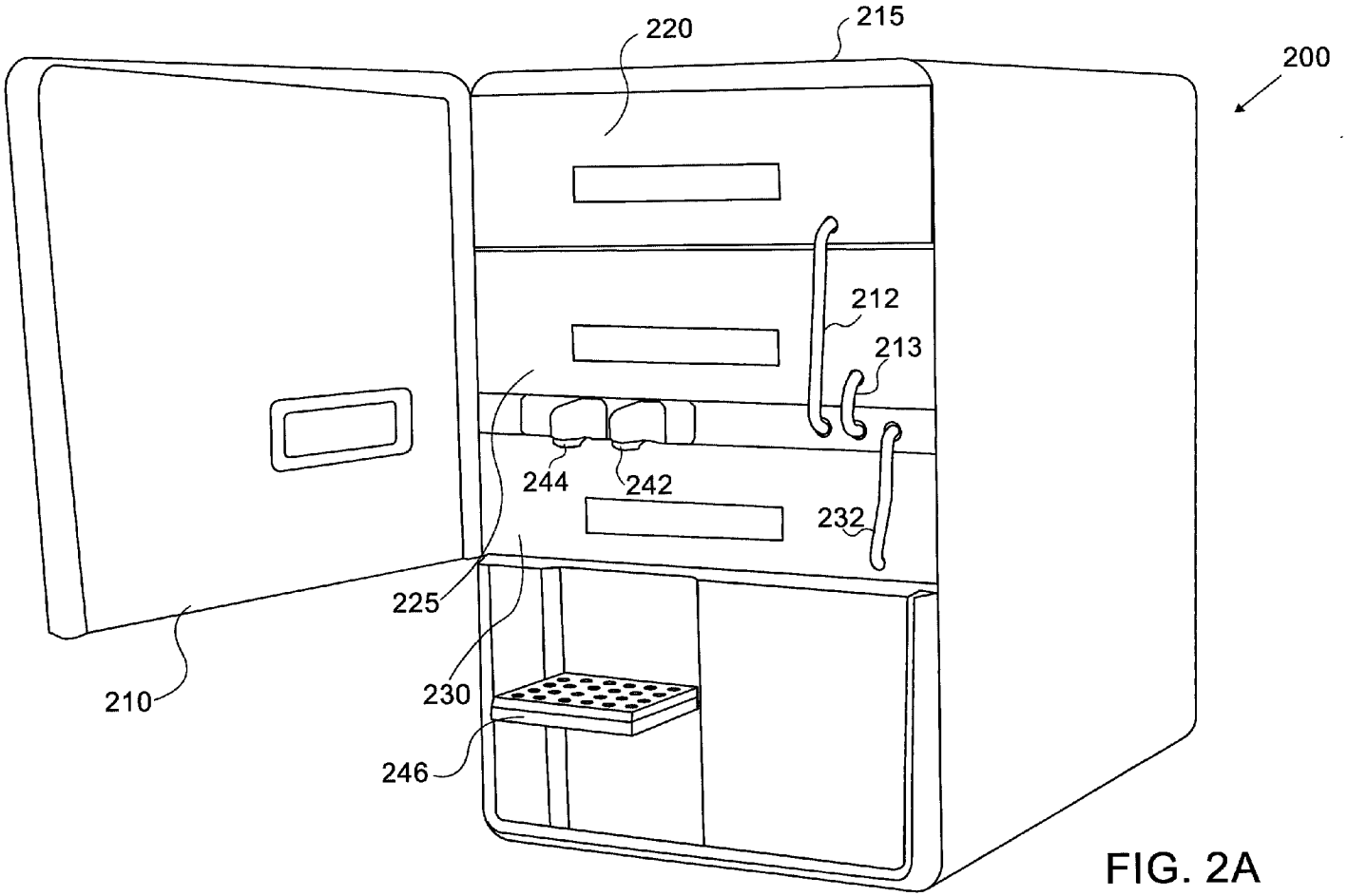
FIG. 2A shows a water dispensing apparatus in open state, according to exemplary embodiments of the disclosed subject matter.

FIG. 2A shows a water dispensing apparatus in open state, according to exemplary embodiments of the disclosed subject matter. The water dispensing apparatus 200 comprises an opening 210. The opening 210 may be positioned in a front of the water dispensing apparatus 200. The opening 210 may move along a hinge (not shown) for enabling replacement of mineral water containers positioned within a housing 215 of the water dispensing apparatus 200. The water dispensing apparatus 200 may also comprise a first faucet 242 for dispensing chilled water and a second faucet 244 for dispensing hot water.

The water dispensing apparatus 200 comprises a first chilled mineral water container 220, a second chilled mineral water container 225 and a hot mineral water container 230. According to the exemplary embodiment of FIG. 2A, the first chilled mineral water container 220 and a second chilled mineral water container 225 are formed as bag in a box package units. In such case, the first chilled mineral water container 220 comprises a first pipe 222 for dispensing mineral water to the first faucet 242 and the second chilled mineral water container 225 comprises a second pipe 213 for dispensing mineral water to the first faucet 242. The first pipe 222 and the second pipe 213 provide secure and sterile water to be dispensed to the user, as the mineral water is not in contact with air when conveyed from the first chilled mineral water container 220 or the second chilled mineral water container 225 to the first faucet 242. The hot mineral water container 230 is connected to the second faucet 244 via a third pipe 232 via which hot mineral water is dispensed to the user. The hot mineral water is heated using a heating device in an intermediate tank (not shown) between the hot mineral water container 230 and the second faucet 244. The intermediate tank may be a hot water tank 445 disclosed in FIG. 4.

In some exemplary cases, the water dispensing apparatus 200 comprises a cooling unit (not shown). In some exemplary cases, the cooling unit cools both the first chilled mineral water container 220 and the second chilled mineral water container 225. In some cases, the cooling unit comprises two cooling outlets, a first cooling outlet for cooling the first chilled mineral water container 220 and a second cooling outlet for cooling the second chilled mineral water container 225. In such case, the first chilled mineral water container 220 may be positioned in a section separated from the section in which the second chilled mineral water container 225 is positioned. The control unit (not shown) may determine to cool only one water container, thus reducing the power consumption of the cooling unit and the power consumption of the water dispensing apparatus 200. In some cases, the cooling unit may cool only the second chilled mineral water container 225 connected to the first faucet 242, while the water in the first chilled mineral water container 220 are in the room temperature. The cooling unit may be connected to an external power source or use a battery comprised in the water dispensing apparatus 200. The size of the cooling unit may be 15 cm high, 30 cm wide and 40 cm deep.

In some cases, both the first chilled mineral water container 220 and the second chilled mineral water container 225 are connected to the first faucet 242 for dispensing chilled water. Alternatively, only one water container selected from the first chilled mineral water container 220 and the second chilled mineral water container 225 is connected to the first faucet 242 for dispensing chilled water. In the latter, the water dispensing apparatus 200 comprises a control unit (not shown) for determining which of the first chilled mineral water container 220 and the second chilled mineral water container 225 is to be connected to the first faucet 242. In some cases, water flows from first chilled mineral water container 220 at room temperature to the second chilled mineral water container 225 where the water is cooled, and from the second chilled mineral water container 225 to the first faucet 242.

In some exemplary cases, the water dispensing apparatus 200 comprises a base 246 for positioning glasses or bottles when dispensing water into said bottles or glasses. The containers are placed on the base 246 when water is dispensed from either the first faucet 242 or the second faucet 244. The base 246 is positioned below the first faucet 242 and the second faucet 244. The base 246 may include one or more openings through which water can be collected in the base 246 when spilled from the container, the first to faucet 242 or the second faucet 244.

The water dispensing apparatus 200 is a compact mineral water apparatus. Further, the water dispensing apparatus 200 is a mineral water apparatus in which the mineral water containers are not shown to the user when using the water dispensing apparatus 200. Further, the water dispensing apparatus 200 provides both chilled mineral water and hot mineral water in a compact apparatus. The water dispensing apparatus 200 is adapted to residential market in which mineral water dispensers are positioned on a kitchen worktop and still be easy to use. When positioned on top of the kitchen worktop, the distance between a kitchen floor and the top of the water dispensing apparatus 200 may be 150 cm. Such distance enables common users to easily replace the water containers and operate the water dispensing apparatus 200 via the first button 132 and the second button 134. The total amount of mineral water in the water dispensing apparatus 200 is about 21 liters, in the embodiment in which the water dispensing apparatus 200 contains two chilled water containers and one hot water containers, each of the tanks contains seven liters. The amount of 21 liters is similar to standard water dispensers. The water dispensing apparatus 200 is different from other water dispensers by providing the same amount of mineral water in a compact apparatus. The size of the compact embodiment of the water dispensing apparatus 200 may be about 40 centimeters deep, 40 centimeters high and 30 centimeters wide.

Figure 2B:
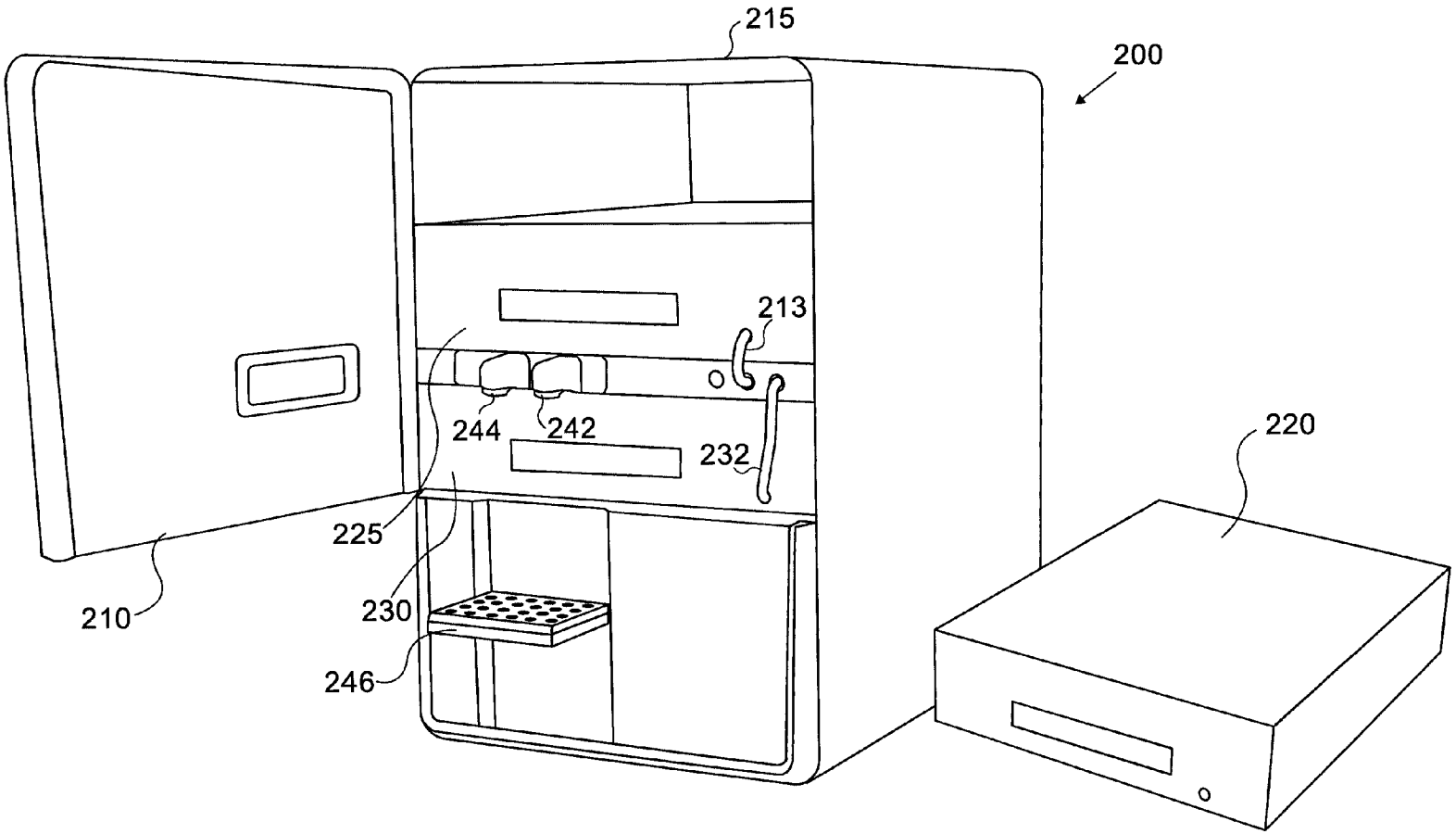
FIG. 2B shows a water dispensing apparatus 200 in which one water container is replaced, according to exemplary embodiments of the disclosed subject matter.

FIG. 2B shows a water dispensing apparatus 200 in which one water container is replaced, according to exemplary embodiments of the disclosed subject matter. FIG. 2B shows the opening 210 of the water dispensing apparatus 200 in an open position. When the opening 210 is in open position, the user can replace water containers of the water dispensing apparatus 200. The user of water dispensing apparatus 200 replaces the first chilled mineral water container 220. Such replacement comprises a step of disconnecting the first pipe 222 from the first faucet 242. Then, the user removes the water container, for example the first chilled mineral water container 220. Next, the user inserts a new water container into the water dispensing apparatus 200 and connects the new water container's pipe into a corresponding faucet, such as the first faucet 242. After the pipe is connected to the faucet, the user closes the opening 210. The first pipe 222 is an integral portion of the first chilled mineral water container 220. The first pipe 222 is replaced every time the first chilled mineral water container 220 is replaced to avoid absorption of contaminants at the first pipe 222 and improve the water quality of the water dispensing apparatus 200.

In some cases, the water dispensing apparatus 200 comprises a mechanism for keeping the opening 210 closed unless opened by the user. Such mechanism may comprise a niche and a pole inserted into the niche, or another mechanism desired by a person skilled in the art. Replacing the water containers of the water dispensing apparatus 200 is much easier than replacing water containers of prior art mineral water dispensers, as the mineral water of the water dispensing apparatus 200 are divided into several water containers. Each of the several water containers comprises significantly less amount of water than prior art mineral water dispensers. For example, prior art mineral water dispensers comprise water containers of about 20 liters, while the water dispensing apparatus 200 comprises water containers of about 7 liters. Such division of mineral water into several water containers enables children, elder or senior users to replace the water containers, as it requires significantly less strength.

In some exemplary cases, the water dispensing apparatus 200 comprises a user interface for enabling a user to control water amount dispensed from the first faucet 242 and the second faucet 244. In such case, the user may input a predefined amount associated with a specific action or input device, such as a button. After inputting the predefined amount, the user may press a button associated with the predefined amount and the water dispensing apparatus 200 dispenses the desired amount.

In some exemplary cases, the water dispensing apparatus 200 reduces power consumption according to the user's request. The user may use the user interface for inputting times in which the water in the water dispensing apparatus 200 is not required to be hot, or not required to be chilled. In such case, the control unit of the water dispensing apparatus 200 may determine to reduce power consumption of the cooling unit or of the heating device.

In some cases, the water dispensing apparatus 200 comprises two or more water containers of the same type, for example chilled water container or hot water container. The control unit of the water dispensing apparatus 200 may indicate to the user when one water container is empty. In such case, the user may replace the empty water container after a period of time elapsed after emptying the first water container while using the mineral water of the second water container.

Figure 3:
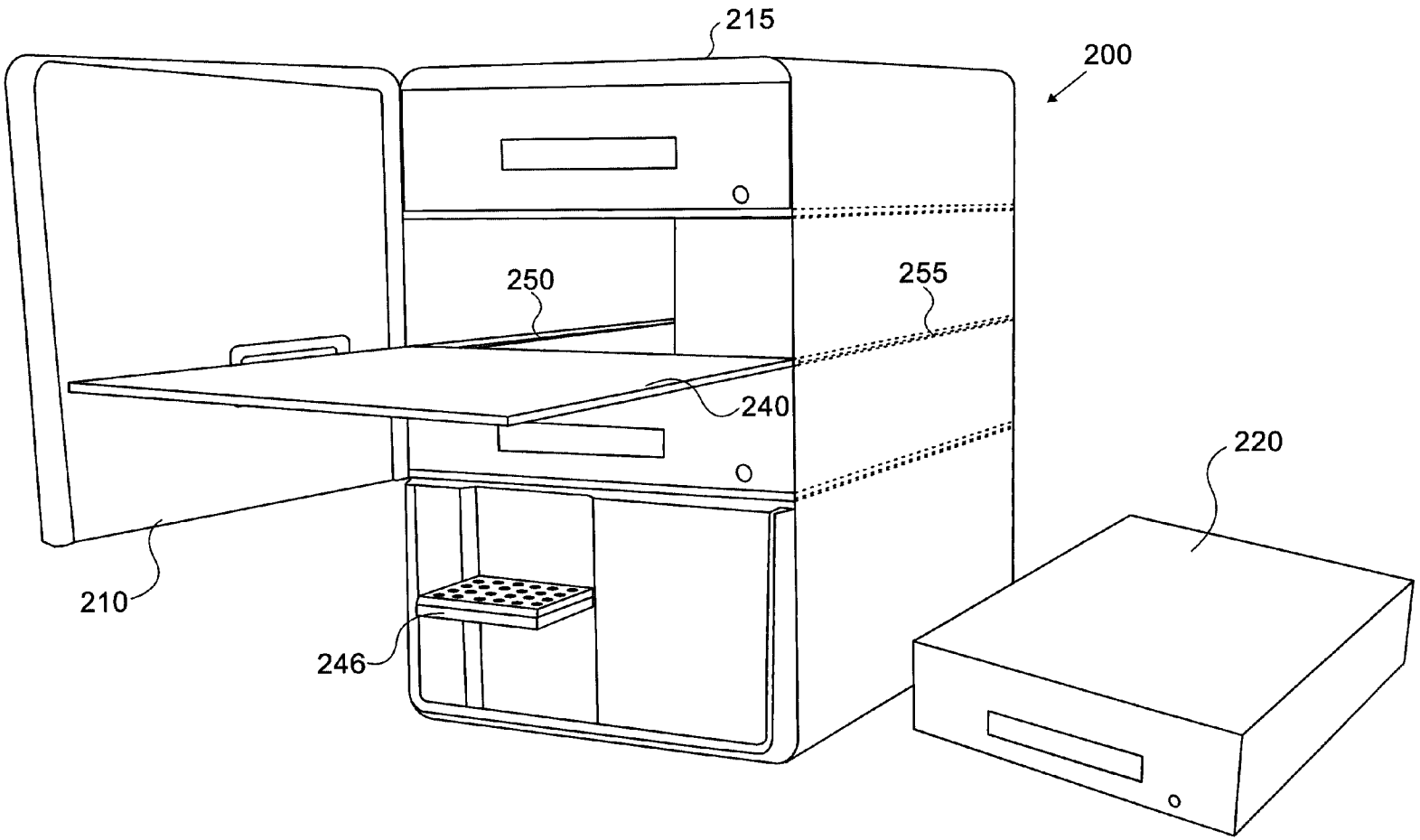
FIG. 3 shows a mechanism for replacing a water container in a water dispensing apparatus, according to exemplary embodiments of the disclosed subject matter.

FIG. 3 shows a mechanism for replacing a water container in a water dispensing apparatus 200, according to exemplary embodiments of the disclosed subject matter. The mechanism for replacing a water container comprises a surface 240. The surface 240 is configured to carry a water container of the water dispensing apparatus 200 when replacing the water container. The surface 240 facilitates inserting the water container into the housing 215 of the water dispensing apparatus 200. The surface 240 is connected to the housing 215 using two hinges or other connecting elements enabling movement of the surface 240 into the housing 215 and out of the housing 215. The surface 240 may be of a drawer-like shape and move along two mechanical tracks 250, 255 within the housing 215 of the water dispensing apparatus 200. The two mechanical tracks 250, 255 limit the movement of the surface 240 in the housing 215. In some cases, only a portion of the surface 240 can be maneuvered outside the housing 215.

The apparatus of the disclosed subject matter may also comprise a boiling unit. The boiling unit may be positioned within the housing 215. The boiling unit enables boiling water to 100 degrees Celsius. The boiling unit may comprise a steam detector for stopping the boiling process when detecting steams. The boiling water may heat water in the heating zone. When there is a predefined amount of steams in the heating zone, the boiling unit stops heating the water in the heating zone.

Figure 4:
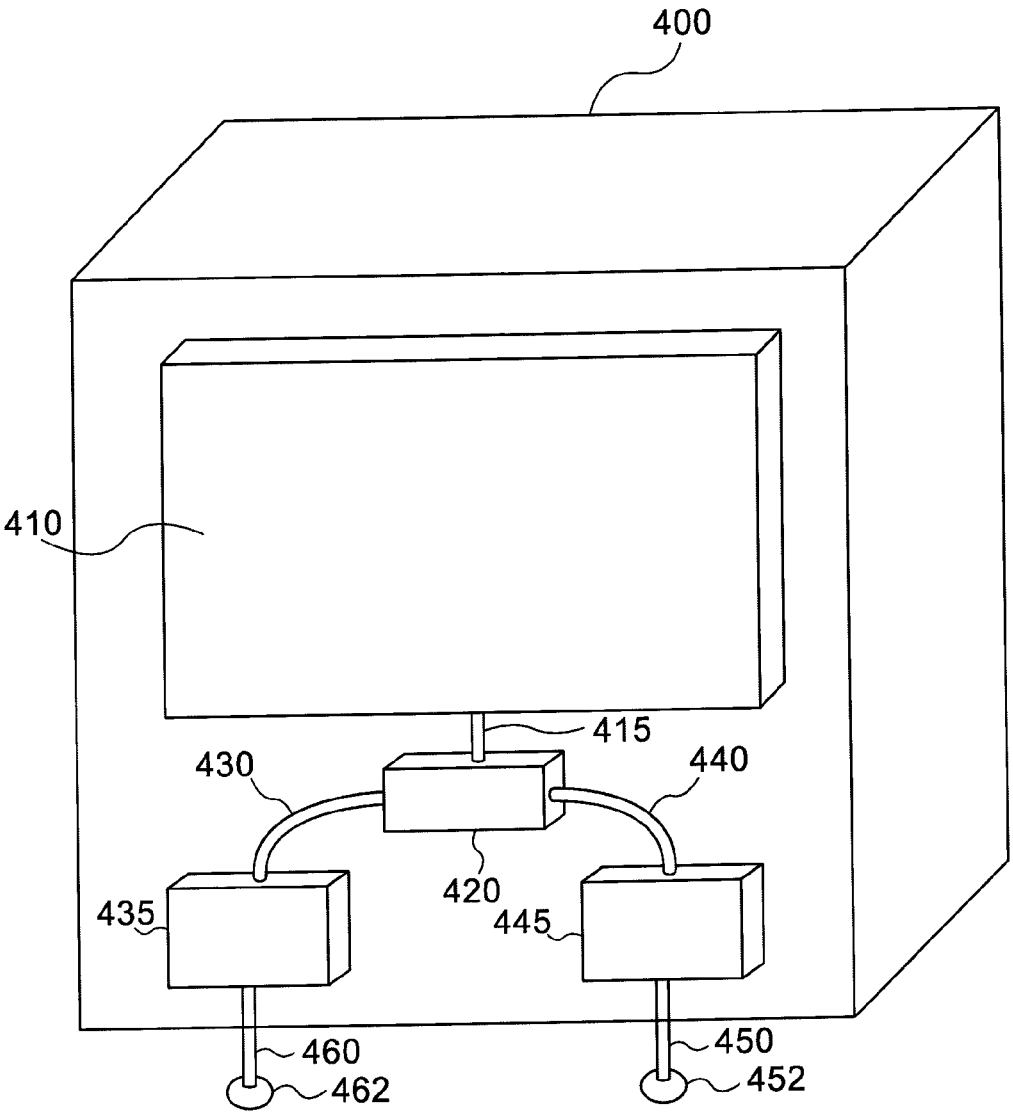
FIG. 4 shows a water dispensing apparatus containing a pump, according to some exemplary embodiments of the subject matter.

FIG. 4 shows a water dispensing apparatus having a single bag in a box container and a pump, according to exemplary embodiments of the disclosed subject matter. The water dispensing apparatus 400 comprises a mineral water container 410.

The mineral water container 410 is a bag in a box water container. The mineral water container 410 may contain mineral water in a room temperature. The volume of the mineral water container 410 may be in a range of 5-12 liters, for example 7 liters. The water dispensing apparatus 400 provides mineral water in a cold water faucet 462 and a hot water faucet 452 using the mineral water container 410. The mineral water container 410 is connected to a pump 420 using a pump tube 415. The pump 420 is configured for pumping water from the mineral water container 410 and transfers the water to a cold water tank 435 and a hot water tank 445. The cold water tank 435 is connected to or comprises a cooling unit for cooling the water within the cold water tank 435. The hot water tank 445 is connected to or comprises a heating unit for heating the water within the hot water tank 445. The pump 420 may pump water upon demand from a user of the water dispensing apparatus 400. The cold water tank 435 and the hot water tank 445 are configured for receiving mineral water from the mineral water container 410. The cold water tank 435 comprises a cooling unit for cooling water received at water temperature from the mineral water tank 410 and supply cooled water to the cold water faucet 462. The hot water tank 445 comprises a heating unit for heating water received at water temperature from the mineral water tank 410 and supply heated water to the hot water faucet 452.

When a user wishes to consume water from the water dispensing apparatus 400, she presses a button or a handle associated with the cold water faucet 462 or the hot water faucet 452. Then, water is dispensed from the cold water tank 435 or hot water tank 445 via the cold water faucet 462 or the hot water faucet 452, respectively. In some cases, the pump 420 is activated when the user presses a key or button in which he requests water to be dispensed. In some other cases, the pump is activated after an amount of water desired by the user is dispensed, or after a predefined amount of water is dispensed. For example, the pump 420 is activated to supply water from the mineral water container 410 to the water tank that dispensed water to the user, for example the cold water tank 435, upon detection of water flowing from the cold water tank 435 to the cold water faucet 462. The pump 420 transfers water to the cold water tank 435 via a cold pump tube 430 and transfers water to the hot water tank 445 via a hot pump tube 440. Cold water is conveyed from the cold water tank 435 to the cold water faucet 462 via cold faucet tube 460. Similarly, hot water is conveyed from the hot water tank 445 to the hot water faucet 452 via cold faucet tube 450.

Figure 5A:
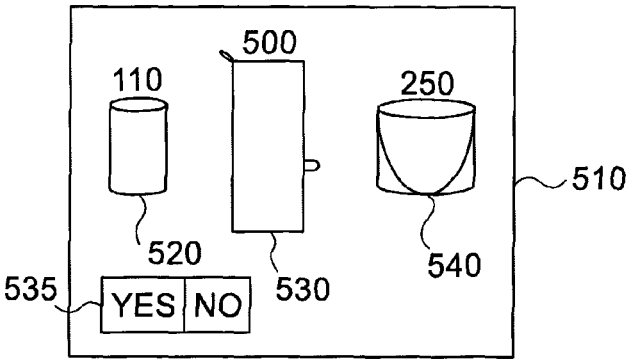
FIGS. 5A-5B show a receiving unit in a water dispensing apparatus 200, according to exemplary embodiments of the disclosed subject matter.
Figure 5B:
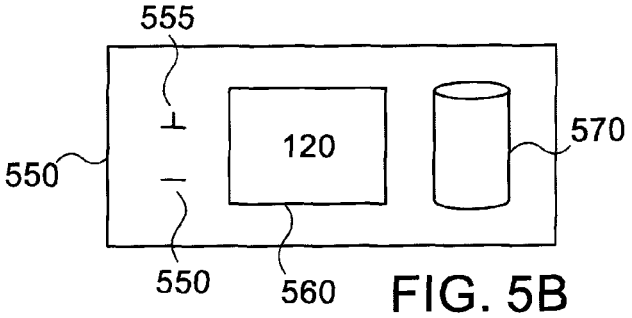

FIGS. 5A-5B show a receiving unit in a water dispensing apparatus 200, according to exemplary embodiments of the disclosed subject matter. FIG. 5A shows a plurality of icons representing different amounts to be dispensed from the water dispenser. The amounts are displayed on a display device 510 on the water dispenser. On a first display, the plurality of icons is displayed. For example, a first icon 520 represents a glass, a second icon 530 represents a pitcher and a third icon 540 represents a bottle. In some exemplary cases, amounts associated with each icon of the plurality of icons are displayed in the vicinity if each icon, for example above each icon. In such exemplary case, the amount 110 ml is associated with a glass of the first icon 520, the amount 500 ml is associated with a pitcher of the second icon 530, and the amount 250 ml is associated with a bottle of the third icon 540.

In some exemplary cases, a YES/NO symbol 535 is displayed on the display device 510 for indicating whether the water dispenser can dispense the amount of water associated with an icon. For example, a control unit within the water dispenser determines that the water dispenser contains less than 500 ml, a NO symbol will be provided when pressing the second icon 530 associated with the amount of 500 ml.

FIG. 5B shows a display 545 enabling a user of the water dispensing apparatus to determine the amount associated with the icons. Icon 570 that represents a cup is associated with a volume value displayed at volume display 560. An icon volume input device enables a user to update the volume value associated with the icon 570. For example, the icon volume input device comprises a plus icon 555 and a minus icon 550 used to add and subtract from the number displayed on the volume display 560. In some exemplary embodiments of the subject matter, the display device may display icons and settings to determine a temperature of the water being dispensed. The icons may comprise a hot temperature icon (not shown), a cold temperature (icon), and a room temperature icon (not shown).

Figure 6:
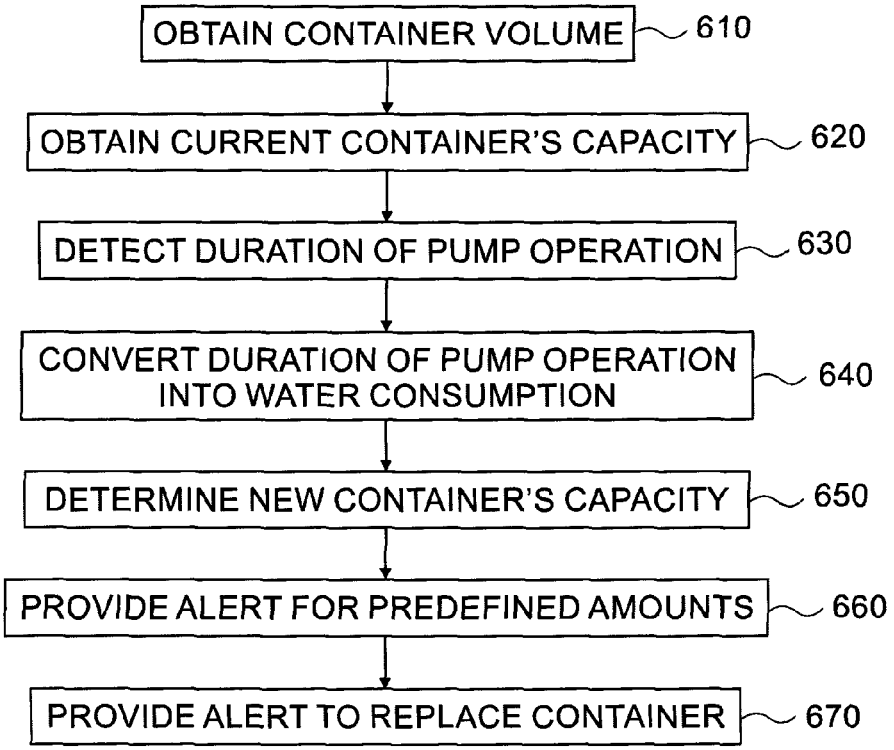
FIG. 6 shows a method for indicating the amount of water within a water 20 container, according to exemplary embodiments of the disclosed subject matter.

FIG. 6 shows a method for indicating the amount of water within a water container, according to exemplary embodiments of the disclosed subject matter. In step 610, a computerized module within the water dispensing apparatus obtains the container volume. The container volume, for example 10 liters, may be predefined, in the water dispensing apparatus settings, or inputted by a user or technician.

In step 620, the computerized module obtains the current capacity of the water container of the water dispensing apparatus. The current capacity may be updated automatically. The initial capacity is the container's volume.

In step 630, the computerized module detects duration of pump operation. The pump pumps water from the bag in a box water container to the water faucets via chilled water container or the hot water container. An electronic sensor may detect the operation of the pump and transmit an indication to the computerized module. The indication may include initiation and termination of the pump's operation.

In step 640, the computerized module converts the duration of pump operation into water consumption. The conversion may be performed by obtaining flow rate of water pumped by the pump from the bag in a box water container. The flow rate may be multiplied by the duration to determine water consumption from the bag in a box water container.

In step 650, the computerized module determines new container's capacity. The new bag in a box water container capacity may be a function of the previous water capacity and the water consumption determined in step 640. For example, if the previous capacity was 6.3 liter, the flow rate of water pumped by the pump is 0.5 liter per minute and the pump operated for 0.5 minutes, the water consumption is 0.25 liters and the new container's capacity is 6.05 liters.

In step 660, the computerized module provides alert for predefined amount of water contained in the bag in a box water container. For example, when there is less than 0.25 liters in the bag in a box water container. In some exemplary cases, the alert is provided when the amount of water in the bag in a box water container is less than any amount associated with an icon displayed in the receiving unit disclosed in FIGS. 5A and 5B.

In step 670, the computerized module provides an alert to replace the water container. In some exemplary cases, the alert is provided when there is still water in the hot water tank and cold-water tank that receive water from the bag in a box water container. This assures that even after the alert provides that the bag in a box container is empty, the water dispensing apparatus can still dispense a predefined amount of water from the cold water tank and from the hot water tank.

Figure 7A:
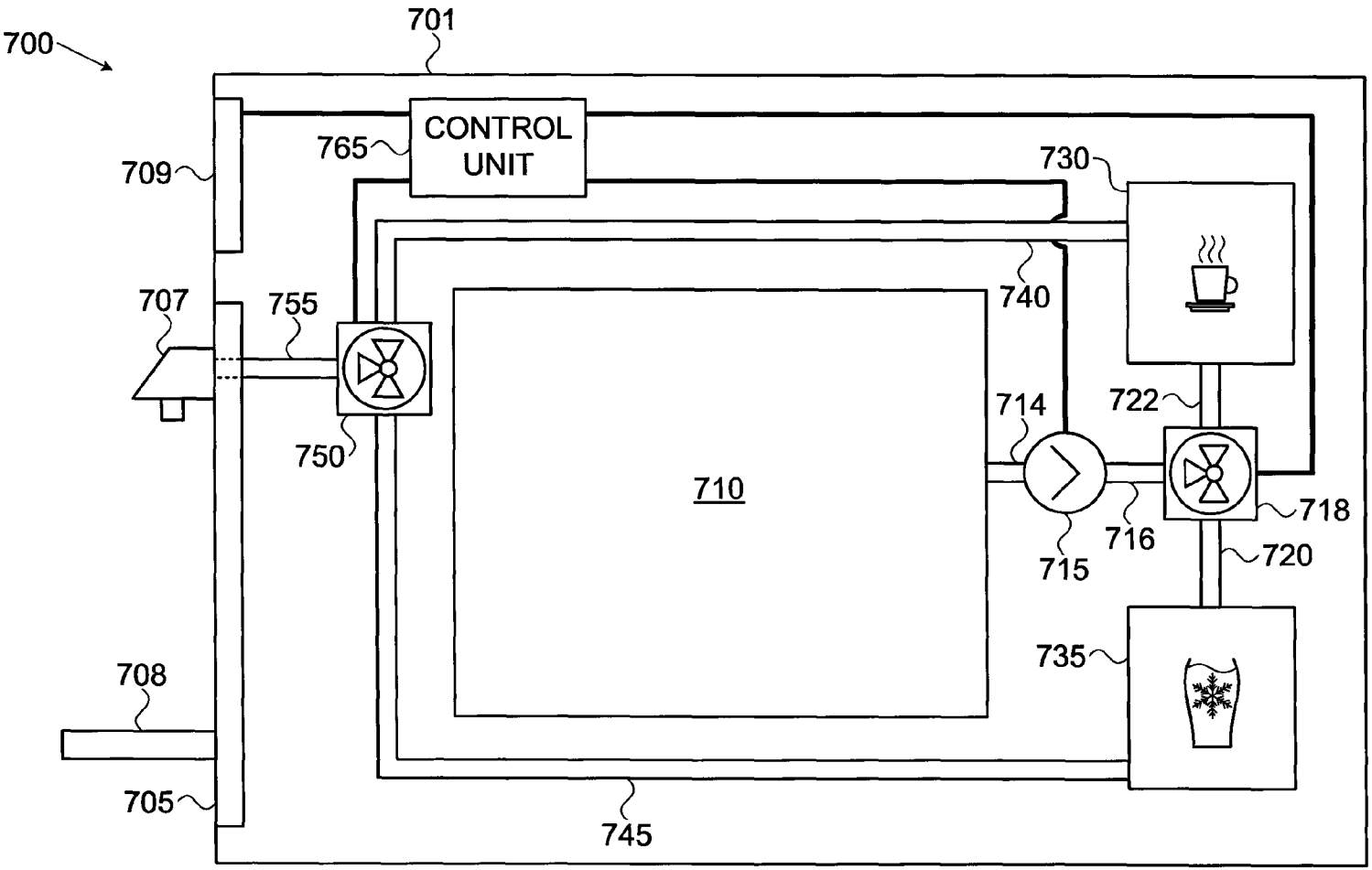
FIG. 7A shows a side view of a water dispensing apparatus with a single faucet, according to some exemplary embodiments of the subject matter.

FIG. 7A shows a side view of a water dispensing apparatus with a single faucet, according to some exemplary embodiments of the subject matter. The water dispensing apparatus 700 comprises a housing 701. The housing is closed, such that the user cannot touch any element in the water dispensing apparatus 700 when an opening 705 of the water dispensing apparatus 700 is closed, and the hot and cold water tanks are isolated from the temperature outside the water dispensing apparatus 700. The water dispensing apparatus 700 does not exceed a height of 70 centimeters. The housing 701 stores a mineral water container 710, such as a bag in box. The mineral water container 710 stores between 6-12 liters, for example 8.5 liters. The mineral water container 710 may be a bag in a box water container. The mineral water container 710 is connected to a pump 715 by a water container pipe 714. The pump 715 is connected to an entering valve 718, by a pump pipe 716. The entering valve 718 allows mineral water to flow to a hot water tank 730 through a hot water entering pipe 722. Heating unit (not shown) heats mineral water pumped into the hot water tank 730. The entering valve 718 further allows mineral water to flow to a cold water tank 735 through a cold water entering pipe 720. A chilling unit (not shown) chills mineral water in the cold water tank 735. The hot water tank 730 and the cold water tank 735 are connected to an outlet valve 750 by a hot water exiting pipe 740 and a cold water exiting pipe 745 respectively. The outlet valve 750 is connected to a dispensing pipe 755, which flows the mineral water from the outlet valve 750 to a faucet 707. The faucet 707 dispenses mineral water into a container (not shown), which may be positioned on a base 708 to receive mineral water from the faucet 707 without requiring a user to hold the container while filling the container with mineral water.

The water dispensing apparatus 700 may also comprise receiving unit 709, which enables the user to elect the temperature of the mineral water and what type of container the user is filling with mineral water. In some exemplary embodiments of the subject matter, the receiving unit 709 is a graphic user interface. The receiving unit 709 transmits a user command received by the receiving unit 709 to a control unit 765. The control unit 765 may send instructions to other elements in the water dispensing apparatus 700. For example, the control unit 765 may send a first instruction to the pump 715 as to when to pump mineral water from the mineral water container 710. The control unit 765 may also send a second instruction to the entering valve 718 that regulates mineral water flow to the hot water tank 730, the cold water tank 735, or both, according to a user request as received at the receiving unit 709. For example, when a user presses on a hot water button on the receiving unit 709, the control unit 765 sends a first instruction to the pump 715 to pump mineral water from the mineral water container 710 and a second instruction to the entering valve 718 to flow the pumped mineral water to the hot water tank 730. The receiving unit 709 may also comprise a cold water button, an extra-hot button, and a lukewarm water button. When the user presses the extra-hot button, the heating unit heats the water in the hot water tank 730 to a degree in a range of 93-97 degrees Celsius. The hot water tank 730 is kept in full position. Hence, when mineral water is pumped into the hot water tank 730, hot mineral water is outputted from the hot water tank 730 via the outlet valve 750 to the user's container.

The elements disclosed above reside within the housing 701. The user does not have access to the pump 715, the hot water tank 730, the cold water tank 735 and the entering valve 718. The user may only open the door and cannot be accessed by the user of the opening 705 in order to replace the mineral water container 710.

The control unit 765 sends a third instruction to the outlet valve 750 to dispense mineral water from the hot water tank 730 or from the cold water tank 735. In some exemplary cases, the mineral water is dispensed at room temperature. The outlet valve 750 dispenses mineral water from the hot water tank 730 and the cold water tank 735 in alternating, time bursts so that the hot and cold water mix and the mineral water dispensed to the container is room temperature; for example, an alternating burst every 10 milliseconds. In accordance with some exemplary cases, the alternating burst may be of various speeds to create mineral water of different temperatures. For example, the user requests mineral water that is warm, the bursts of water pumped from the hot water tank 730 are longer than the bursts of mineral water pumped from the cold water tank 735. All pipes and water tanks comprising the water dispensing apparatus 700 are filled with mineral water, which enables the rapid dispensing of water and to have a small water container 710. The alternating bursts of mineral water from the hot water tank and the cold water tank enables regulation of mineral water temperature without a mixing container as known in the prior art devices. Lack of said mixing container reduces the volume consumed by the water dispensing apparatus 700 of the disclosed subject matter.

Figure 7B:
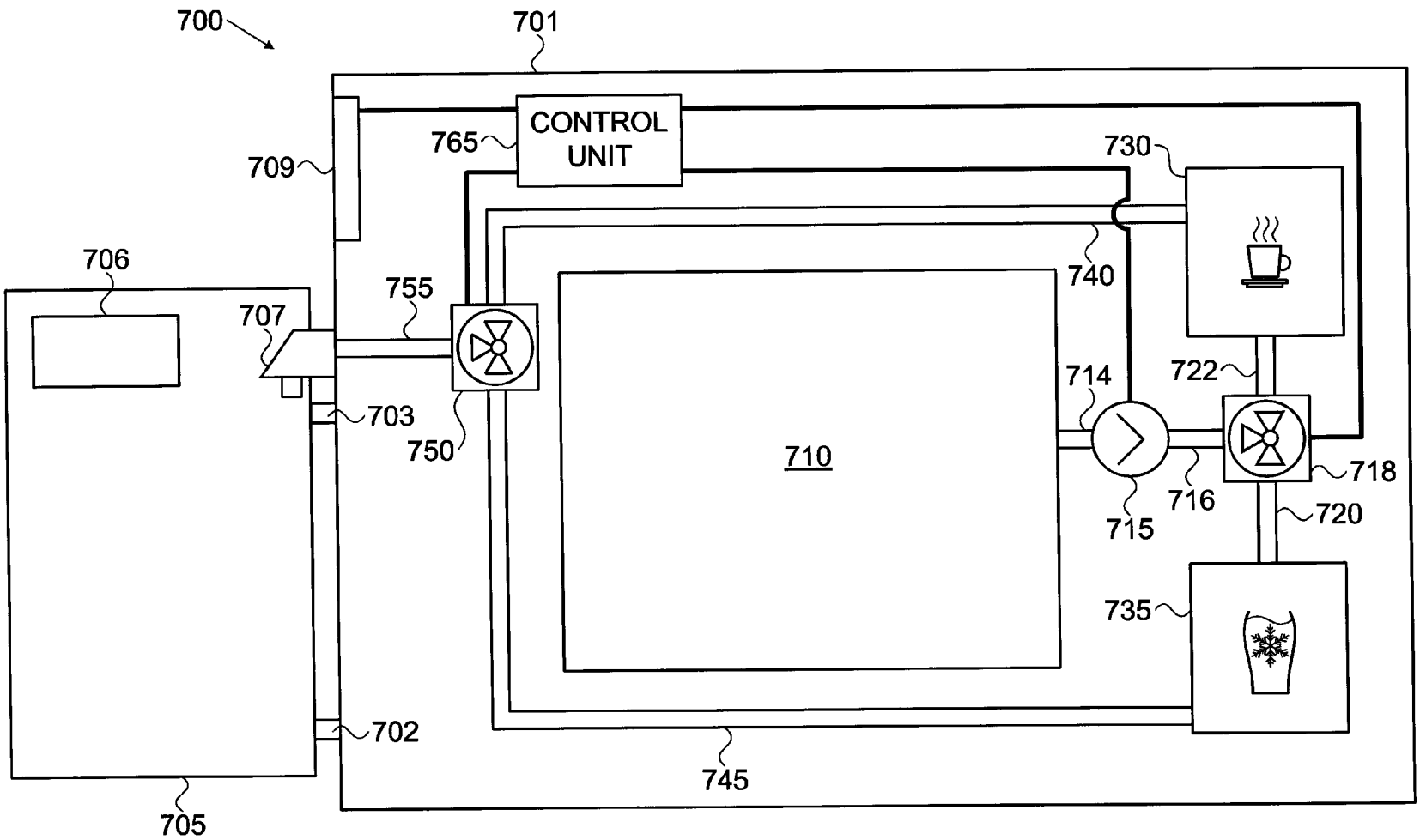
FIG. 7B shows a side view of the water dispensing apparatus with a single faucet with an opening opened, according to exemplary embodiment of the subject matter.
Figure 7C:
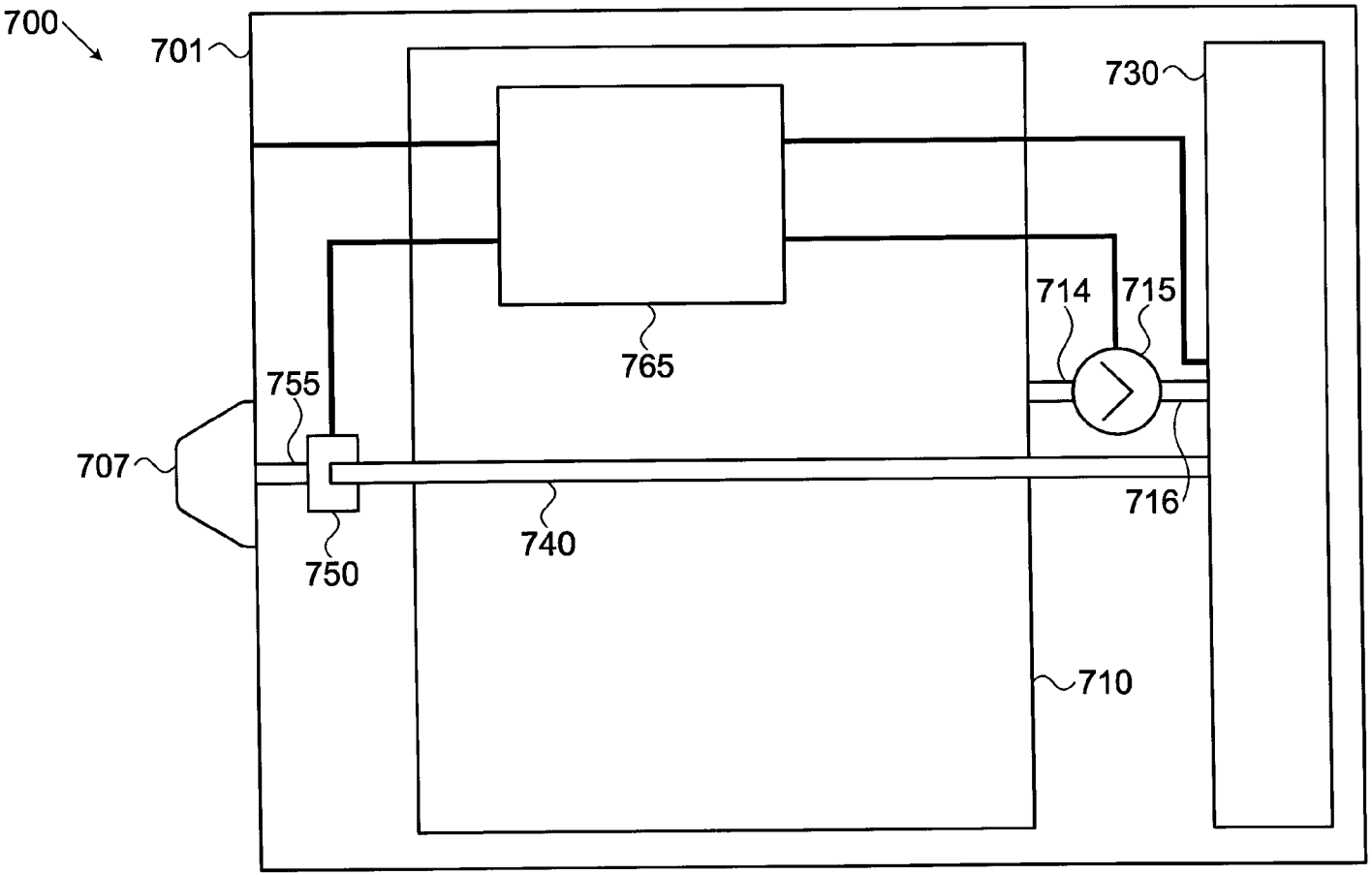
FIG. 7C shows an upper view of the water dispensing apparatus with a single faucet, according to exemplary embodiments of the subject matter.

FIG. 7B shows a side view of the water dispensing apparatus with a single faucet with an opening opened, according to exemplary embodiment of the subject matter. The opening 705 is opened and swings on hinges 702 and 703, which connect the opening 705 to the housing 701. The opening 705 comprises a window 706 through which the faucet 707 sticks out. FIG. 7C shows an upper view of the water dispensing apparatus with a single faucet, according to exemplary embodiments of the subject matter.

Figure 8:
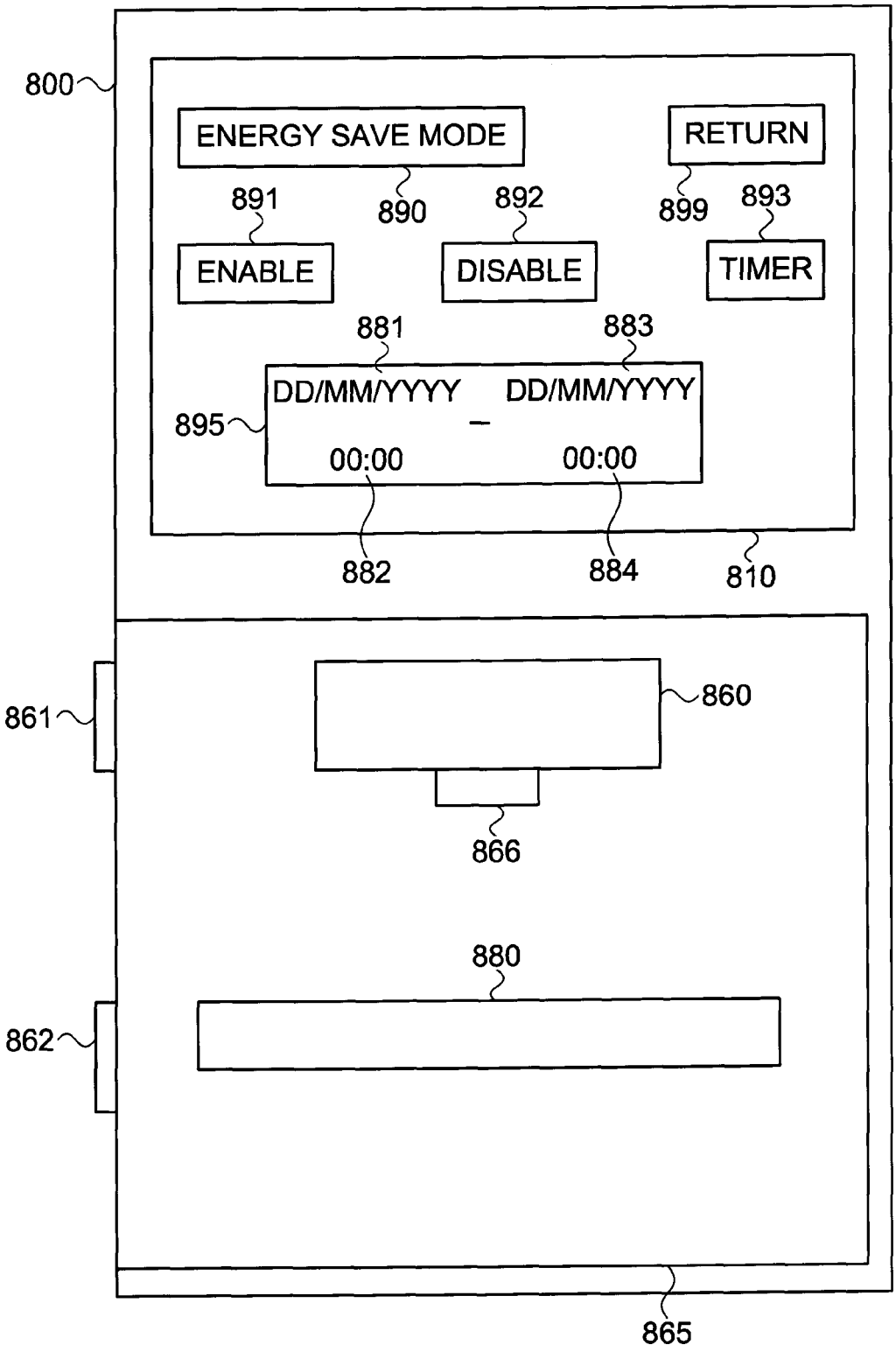
FIG. 8 shows an opening of a water dispensing apparatus with a receiving unit displaying energy saving mode interface, according to exemplary embodiments of the subject matter.

FIG. 8 shows an opening of a water dispensing apparatus with a receiving unit displaying energy saving mode interface, according to exemplary embodiments of the subject matter. The water dispensing apparatus comprises the receiving unit 810, which enables a user to elect the temperature, quantity of the water dispensed, and to enable energy saving mode. In some exemplary embodiments of the subject matter, the receiving unit 810 is a graphic user interface. After the user selected to enable the energy saving mode, the receiving unit 810 displays an energy saving mode display 890, which may be a touch screen display. The energy saving mode display 890 comprises an enable icon 891, which the user presses to switch the water dispensing apparatus 700 of FIG. 7A to energy saving mode. The energy saving mode display 890 comprises a disable icon 892, which the user presses to turn off the energy saving mode. The energy saving mode display 890 may comprise a timer icon 893, which enables the user to designate a time window in which the user wants the water dispensing apparatus 700 to switch to energy saving mode.

The timer icon 893 displays a timer setting timer setting interface 895, which may comprise a start date icon 881, a start time icon 882, an end date icon 883 and an end time icon 884, which the user uses to designate the length of time the water dispersing apparatus 700 remains in energy saving mode. For example, the user is going on a vacation and wants the water dispensing apparatus 700 to conserve energy while the user is away. The user selects the timer icon 893, and elects when the water dispensing apparatus 700 enables the energy saving mode by inserting a start date, such as Dec. 24, 2012, by inserting 12/24/2012 into the start date icon 881. The user may choose a specific time of the day by inserting a time into the start time icon 882, for example 04:30. The user then selects the time when the energy saving mode is disabled by inserting a date, such as Jan. 6, 2013, by inputting 01/06/2012, into the end date icon 883. The user may also select the exact end time by inputting a time, such as 17:15 into the end time icon 884.

In some cases, the timer icon 893 enables the user to elect a time span for during which the water dispensing apparatus 700 is in energy saving mode. For example, the user is running errands and wishes the water dispensing apparatus 700 to go into energy saving mode for a couple of hours. The user presses the timer icon 893 until the time elected is two hours in which the water dispensing apparatus is in energy saving mode. Once the two hours are over the water dispersing apparatus 700 disables the energy saving mode and returns to standard functioning mode. The energy saving mode 890 to may comprise a return icon 899 to exit the energy saving mode display 890. In some other cases, the user may elect energy saving mode for specific hours in a day for a plurality of days. For example, the user may set the water dispensing apparatus 700 to energy saving mode on Saturdays and Sundays between April and August, and set the water dispensing apparatus 700 to energy saving mode between 8 PM to 8 AM every working day during a time span of weeks or months.

While the disclosure has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

The invention claimed is:

1. A water dispensing apparatus, comprising:

a housing;

a mineral water container containing mineral water positioned within the housing;

a water faucet configured to dispense hot mineral water and cold mineral water;

a cold water tank for receiving water at room temperature from the mineral water and cooling the mineral water contained therein, wherein the cold water tank is connected to a cooling unit for cooling the water in the cold water tank;

a hot water tank for receiving mineral water at room temperature from the mineral water container and heating the mineral water contained therein, wherein the hot water tank is connected to a heating unit for heating the mineral water in the hot water tank;

a pump to dispense the mineral water from the mineral water container to the cold water tank and the hot water tank, said mineral water is then pushed to the water faucet;

wherein the cooling unit is positioned within the housing; and an entering valve positioned between the pump and the hot water tank and the cold water tank, wherein the entering valve regulates water flowing from the pump to either the hot water tank or the cold water tank.

2. The water dispensing apparatus of claim 1, further comprising a receiving unit for receiving a command from a user of the water dispensing apparatus for receipt of said mineral water.

3. The water dispensing apparatus of claim 2, further comprising a control unit for receiving the command from the receiving unit and transmitting a first instruction to the pump to pump the mineral water from the mineral water container and further transmits a second instruction to the entering valve to allow the mineral water to flow from the pump to a water tank selected from a group consisting of the hot water tank and the cold water tank according to the user's command.

4. The water dispensing apparatus of claim 1, further comprising an output valve positioned before the mineral water is received at the faucet, said output valve regulates flow of the mineral water to the faucet; wherein the output valve receives hot water from the hot water tank through a hot water pipe and receives cold water from the cold water tank through a cold water pipe.

5. The water dispensing apparatus of claim 4, wherein the output valve dispenses water to the faucet in alternating bursts to mix the hot water and cold water such that the mineral water dispensed from the faucet is room temperature.

6. The apparatus according to claim 1, wherein the apparatus is adapted for residential users.

7. The apparatus according to claim 1, wherein the apparatus is adapted to enable replacement of the mineral water container on a kitchen worktop when the apparatus is positioned on the kitchen worktop.

8. The apparatus according, to claim 1, further comprising a receiving unit, wherein the receiving unit comprises a plurality of icons displayed on a display device of the apparatus, wherein each of said plurality of icons represents an amount of mineral water dispensed by the apparatus.

9. The apparatus according to claim 1, wherein the height of the water dispensing apparatus is lower than 60 centimeters.

10. The apparatus according to claim 1, further comprising a boiling unit for boiling the mineral water in the hot water tank.

11. The apparatus according to claim 1, further comprising a surface on which the mineral water container is mounted, wherein said snake is removable from the apparatus when replacing the mineral water container.

12. The apparatus according to claim 8, wherein the receiving unit further comprises an energy saving mode.

13. The apparatus according to claim 12, wherein the energy saving mode comprises a timer option to elect the time the energy saving mode is enabled.

14. The apparatus according to claim 1, wherein the mineral water container is formed as a bag and box package unit.

* * * * *